US007127863B2

(12) United States Patent
Simmons

(10) Patent No.: US 7,127,863 B2
(45) Date of Patent: Oct. 31, 2006

(54) COLUMN/BEAM INTERCONNECT NUT-AND-BOLT SOCKET CONFIGURATION

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 380 days.

(21) Appl. No.: 10/700,029

(22) Filed: Nov. 3, 2003

(65) Prior Publication Data

US 2004/0139683 A1 Jul. 22, 2004

Related U.S. Application Data

(60) Provisional application No. 60/424,081, filed on Nov. 5, 2002.

(51) Int. Cl.
*E04C 3/30* (2006.01)

(52) U.S. Cl. ..... 52/737.5; 52/736.5

(58) Field of Classification Search ..... 52/737.5, 52/698, 705, 721.5, 737.1, 736.4; 403/22; 411/90, 91, 166
See application file for complete search history.

(56) References Cited

U.S. PATENT DOCUMENTS 1,232,024 A * 7/1917 Garland et al. ..... 411/91
2,411,629 A * 11/1946 Lane ..... 411/400
2,513,037 A * 6/1950 McLaughlin ..... 411/166
3,319,691 A * 5/1967 Fisher ..... 411/96
6,554,366 B1 * 4/2003 Zeeuw et al. ..... 297/440.15
6,773,200 B1 * 8/2004 Cole ..... 403/378
6,837,016 B1 * 1/2005 Simmons et al. ..... 52/655.1

* cited by examiner

*Primary Examiner*—Naoko Slack
*Assistant Examiner*—Jessica Laux
(74) *Attorney, Agent, or Firm*—Jon M. Dickinson PC; Robert D. Varitz PC

(57) ABSTRACT

Column/I-beam interconnect structure including an attaching plate joined to an I-beam end. This plate possesses, along its lateral margins, angularly oriented upper and lower through-passages, each characterized with a reception axis, and designed to receive, along that axis, portions of a hex nut-and-bolt set which is used to clamp together two adjacent, angularly related attaching plates. The socket portions, or outer chambers, of the through-passages are formed with spaced and generally parallel-planar upper and lower surfaces which act in these socket portions to restrain a received hex nut against rotation about its own rotational assembly axis which, in the socket portion, is coincident with the socket portion's reception axis. This arrangement uniquely allows for a structural configuration wherein laterally directed moment loads are transferred very closely relative to the elevations of such beams' flanges, and more specifically, as close as possible to key axes of force transmission such as those that lie laterally centrally in the planes of these flanges.

2 Claims, 4 Drawing Sheets

COLUMN/BEAM INTERCONNECT NUT-AND-BOLT SOCKET CONFIGURATION

CROSS REFERENCE TO RELATED APPLICATION

This patent application claims priority to prior-filed, currently abandoned, U.S. Provisional Patent Application No. 60/424,081, filed Nov. 5, 2002 for "Column/Beam Interconnect Nut-and-Bolt Socket Configuration". The entire contents of that prior application are hereby incorporate herein by reference.

BACKGROUND AND SUMMARY OF THE INVENTION

This invention relates to column/beam interconnect structure, and in particular to such structure which is employed to interconnect structural columns and beams that are employed in a building frame structure to handle both gravity and moment loads. This structure is also referred to herein as beam-to-column attaching structure.

A preferred embodiment of the invention is described and illustrated herein in the context of interconnecting square cross-section, hollow, steel columns and steel I-beams through interengageable inner an outer collar structures that are interposed a column and a beam. More specific details of such collar structures per se, beyond those which are pictured and described herein to disclose the present invention, can be found in currently co-pending Regular U.S. patent application Ser. No. 09/943,711, filed Aug. 20, 2001, for "Moment-Resistant Building Frame Structure Componentry and Method". Accordingly, reference is here made to that application as a source of background information.

Where columns and beams of the type mentioned above interconnect, and with specific attention paid to the issue of how such an interconnection is designed to handle moment loads, the regions of adjacency of the ends of upper and lower I-beam flanges and the nearby sides of columns are especially important. In these regions, the more that it is possible to assure that laterally directed moment loads are transferred very closely relative to the elevations of such beams' flanges, and more specifically, as close as possible to key axes of force transmission, such as those that lie laterally centrally in the planes of these flanges, the better is the use that is made of the full capabilities of such columns and beams to manage moment loads.

The present invention addresses this matter in unique, special and effective ways by helping to assure, in particular, that lateral moment loads are so transferred. With reference to the inner and outer collar structures mentioned above, and in accordance with implementation of the present invention, socket-drive hex nut-and-bolt sets are employed to clamp each outer collar to an associated inner collar. The inner collar includes a plurality of inner plate components (also referred to as attaching plates), one for each face of a column, suitably attached, as by welding, to the column faces. In the context of describing the present invention, a column has four, orthogonally related faces. The inner collar plate components employed for such a column thus are four in number, and when distributed at a particular longitudinal location along a column, "wrap" around the column, and meet one another, lateral edge to lateral edge, at right-angle corners.

The outer collar is also formed of four plate components, or plates, at least some of which are attached, also as by welding, to the ends of I-beams. The number of such outer collar plates attached to beam ends at a given collar connection with a column is determined by the number of beams that are to be connected to the column at that point. These plates, which are anchored to the ends of I-beams, are substantially planar in nature, and possess spaced inner and outer faces which, with interconnected columns and beams in place, face the outside of the column and the confronting near end of a connected I-beam, respectively. These inner and outer faces are also referred to herein respectively as "other" and "one" faces, and the outer collar plates are referred to collectively as angular-modularity plates.

The inner and outer collar plate components are provided with gravity-seating/locking, complementary mating structure, and the vertical lateral edges of the outer-collar plate components are provided with suitably angled (45° in the illustration now being given) through-bores and outer sockets, or outer chambers, that align across corners when two such components are properly orthogonally (angularly) positioned relative to two inner collar plate components that are attached to two orthogonally adjacent faces in a column.

The mentioned nut-and-bolt sets, or assemblies, are employed in such aligned through-bores and sockets, with the head of each bolt received within one of the associated sockets and with the nut received in the other associated socket. These nut-and-bolt sets are appropriately tightened to clamp a fully assembled outer collar structure onto a receiving inner collar structure. When so tightened, the nut-and-bolt sets join adjacent outer-collar plates, and participate as tension elements with respect to the handling of moment loads between a column and a beam.

Significantly, the present invention proposes an arrangement wherein pairs of vertically spaced nut and bolt sets are disposed, elevationally, very close to (but within the space between) the two spaced planes which are occupied by the upper and lower flanges in an associated, adjacent, anchored-to I-beam. They thus are positioned in a manner to maximize their capabilities for moment load handling. This "close to" spacing is uniquely permitted because of the fact that the sockets in each associated through-bore and outer socket structure are formed with vertically spaced, substantially parallel-planar surfaces which provide modest clearance for receiving two of the usual diametrally spaced parallel-planar surfaces on the outside of a hex nut, with these two sides of that nut closely confronting these socket-structure surfaces, thus to prevent the nut from rotating in a socket about it own "assembly axis" which co-aligns with the axis of alignment associated with that socket. The nut-and-bolt assemblies discussed herein are referred to as having assembly axes which are those axes about which relative rotation between an associated nut and bolt takes place.

Given this configuration, a nut-and-bolt set can be tightened simply by rotating the socket-drive bolt head in the set without the need for using any tool to prevent nut rotation. Were the structure which has just been described, configured differently to require the use, for example, of a wrench to hold a nut against rotation, larger socket space would have to be provided to accommodate the insertion of such a wrench so as to be able to grip the nut. Such an accommodation would be accompanied by a requirement that upper and lower nut-and-bolt sets, and specifically their axes of force transmission, not be so closely spaced to I-beam upper and lower flanges, and a consequence of this would be that the effective movement-handling capabilities of a nut-and-bolt set would be diminished for the reason suggested earlier relating to proximity to the "key" axes of beam/column force transmission that lie centrally in the planes of a beam's flanges. Also, this would mean that each outer collar plates would have to have more material removed in order to provide wrench access to a nut, and the associated outer collar plate per se would, accordingly, be somewhat weakened in comparison with such a plate prepared in accordance with this invention.

These and other features and advantages which are offered by the present invention will become more fully apparent as the description which now follows is read in conjunction with the accompanying drawings.

DESCRIPTION OF THE DRAWINGS

FIGS. 1A, 1B, 1C carry most of the structural parts reference numerals in this disclosure.

DETAILED DESCRIPTION OF THE INVENTION

Figure 1A:
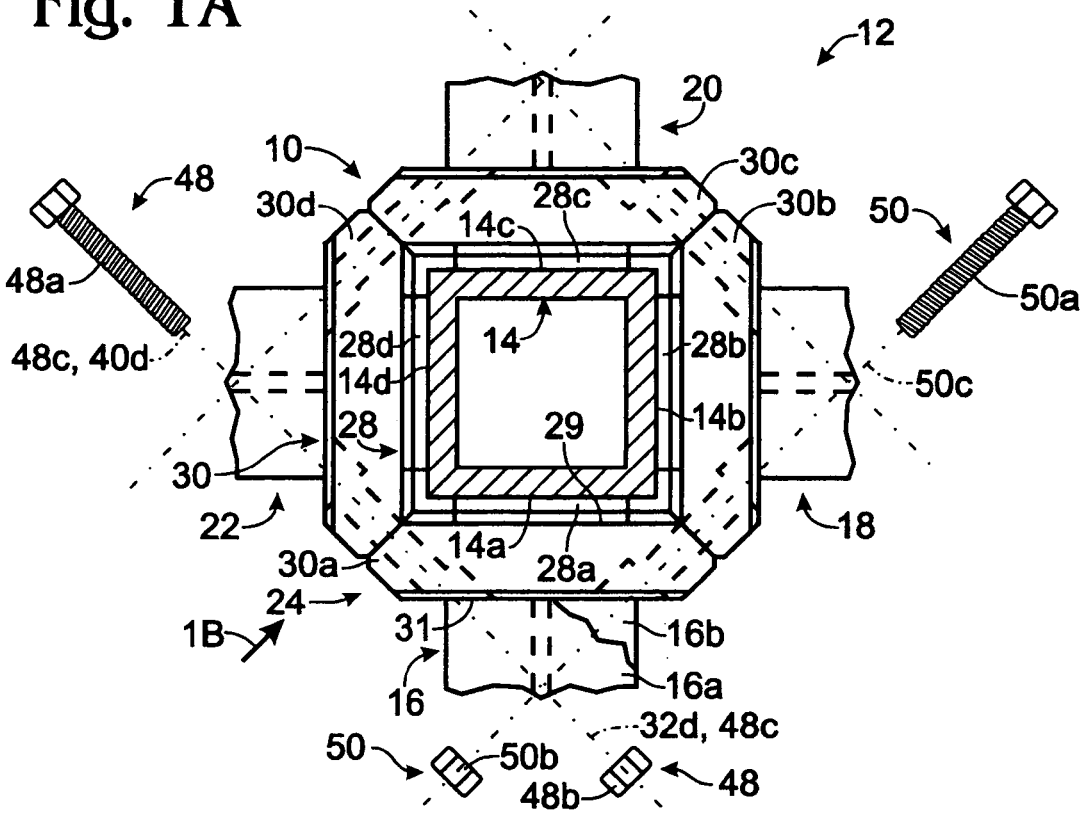
FIG. 1A is a fragmentary, plan, cross-sectional view of column/I-beam interconnect structure which is constructed in accordance with a preferred and best-mode embodiment of the present invention.

Turning now to the drawings, indicated generally at 10 in FIG. 1 is a single, nodal gravity and moment connection which exists in a building frame structure 12 between an upright, hollow, square cross-section steel column 14, and four, horizontal, orthogonally related steel I-beams 16, 18, 20, 22. As will be explained, connection 10 employs four (one for each of the ends of beam 16, 18, 20, 22 which are next to the column) column/I-beam interconnect structures, such as the one shown generally at 24 for I-beam 16. These structures are also referred to herein as beam-to-column attaching structures. These interconnect structures are constructed in accordance with the preferred and best-mode embodiment of the present invention.

Column 14 includes four angularly (orthogonally) disposed planar faces 14*a*, 14*b*, 14*c*, 14*d* which face beams 16, 18, 20, 22, respectively. The illustrative right angles which exist between adjacent pairs of column faces are referred to herein as known angles. It should be understood that while right-angles are pictured herein, other-value "known angles" could be the case. The I-beams shown include upper and lower, horizontally planar, vertically spaced flanges, such as upper and lower flanges 16*a*, 16*b*, respectively, in beam 16, which are joined to the beam's upright planar central web, such as web 16*c* which joins flanges 16*a*, 16*b*.

Figure 1B:
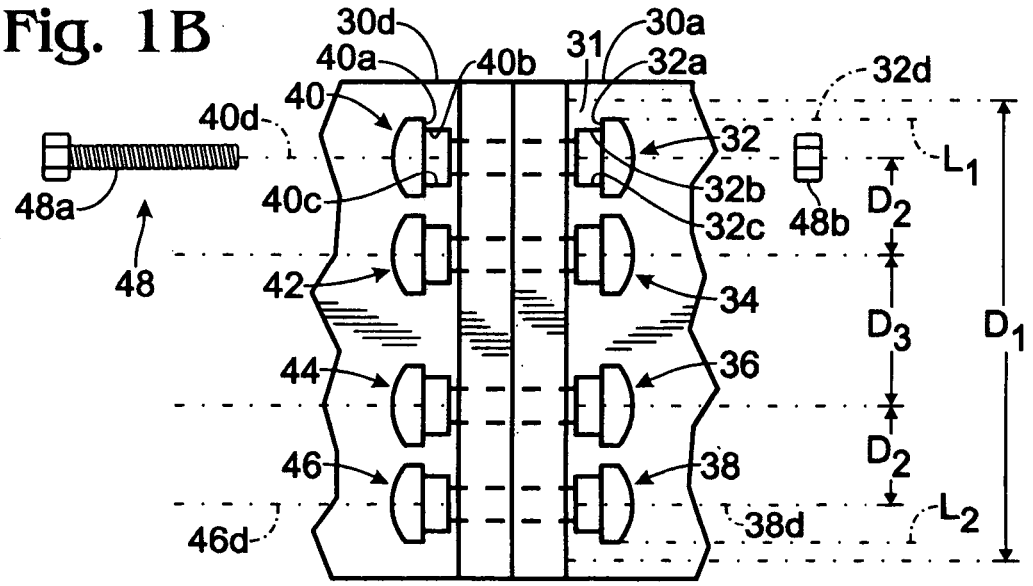
FIG. 1B is a fragmented view taken generally as indicated by arrow 1B in FIG. 1.
Figure 1C:
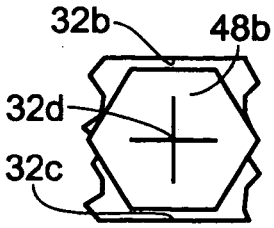
FIG. 1C presents a small fragmentary detail showing a hex nut received and constrained in a though-passage chamber (socket) according to the invention.
Figure 2:
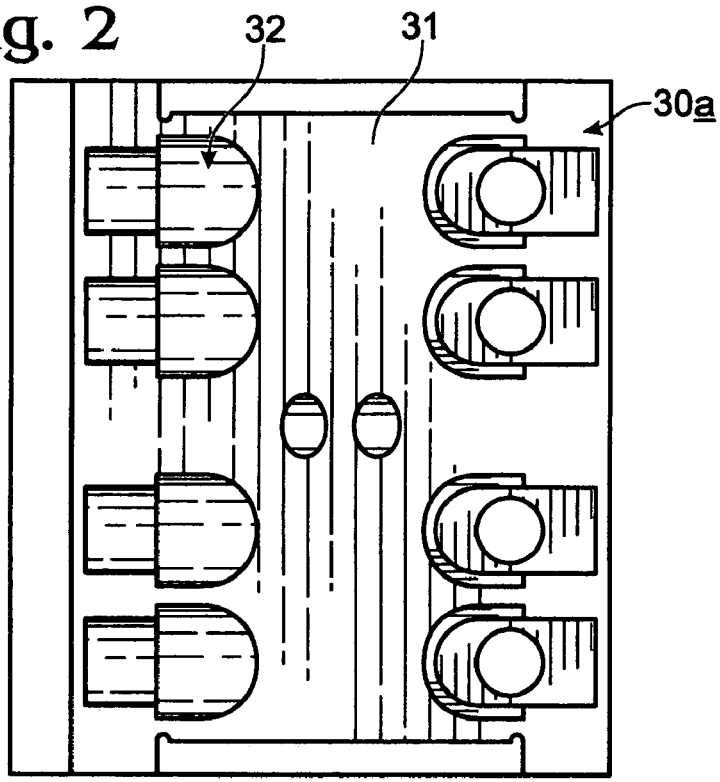
FIGS. 2 and 3 are isometric photographic views of an isolated beam-attachable (outer-collar) plate made in accordance with a preferred and best-mode embodiment of the invention.
Figure 3:
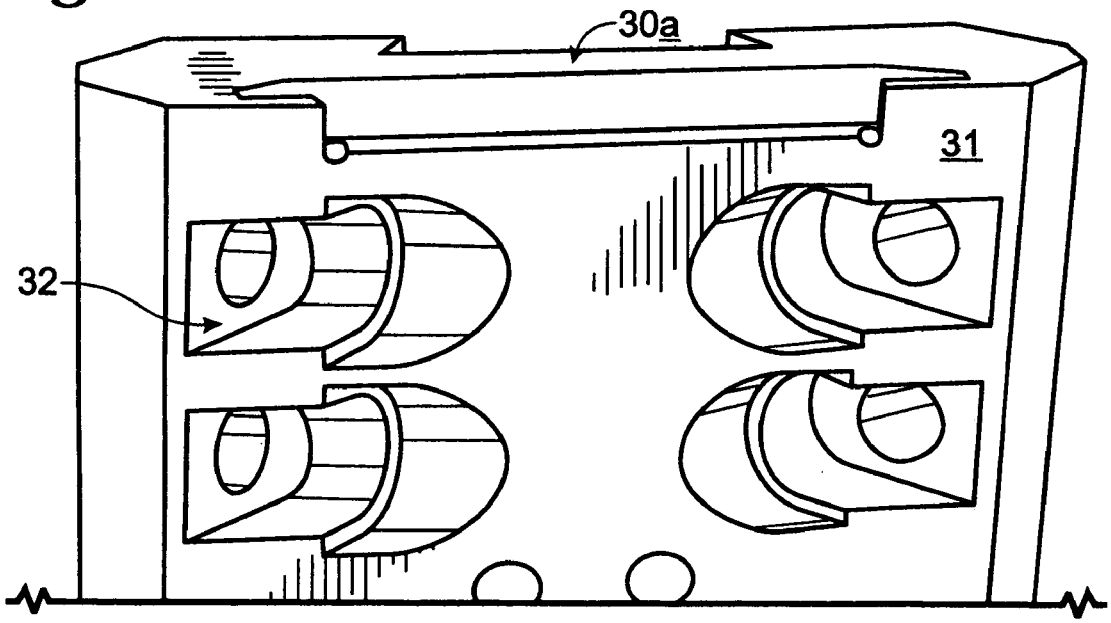
Figure 4:
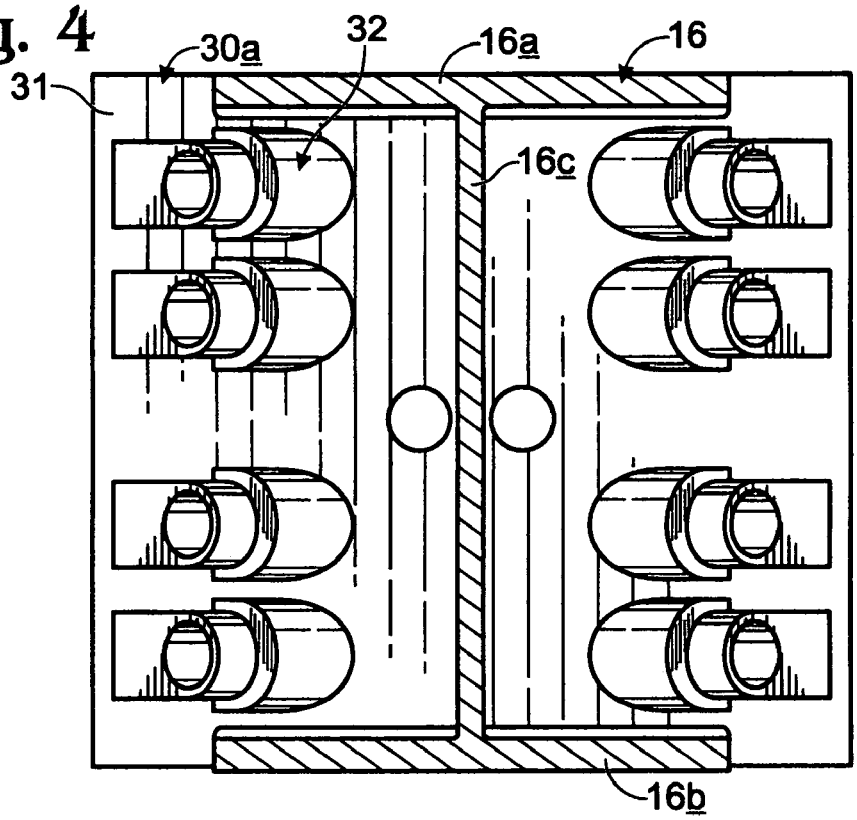
FIGS. 4 and 5 are isometric photographic views of the same collar plate illustrated in FIGS. 3 and 4, shown anchored, as by welding, to a fragment of the end (central web and flanges) of a conventional I-beam.
Figure 5:
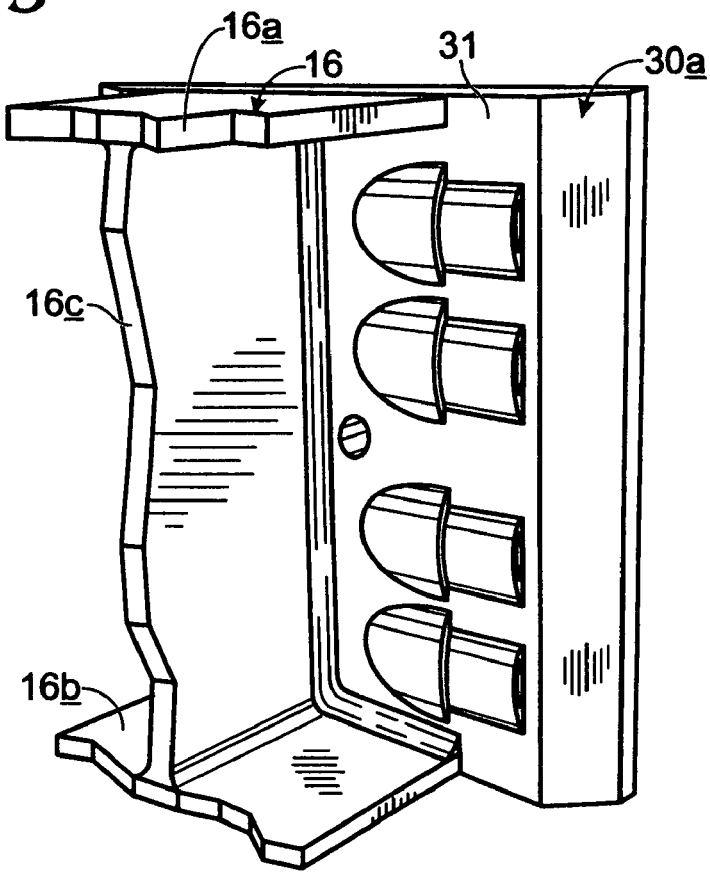
Figure 6:
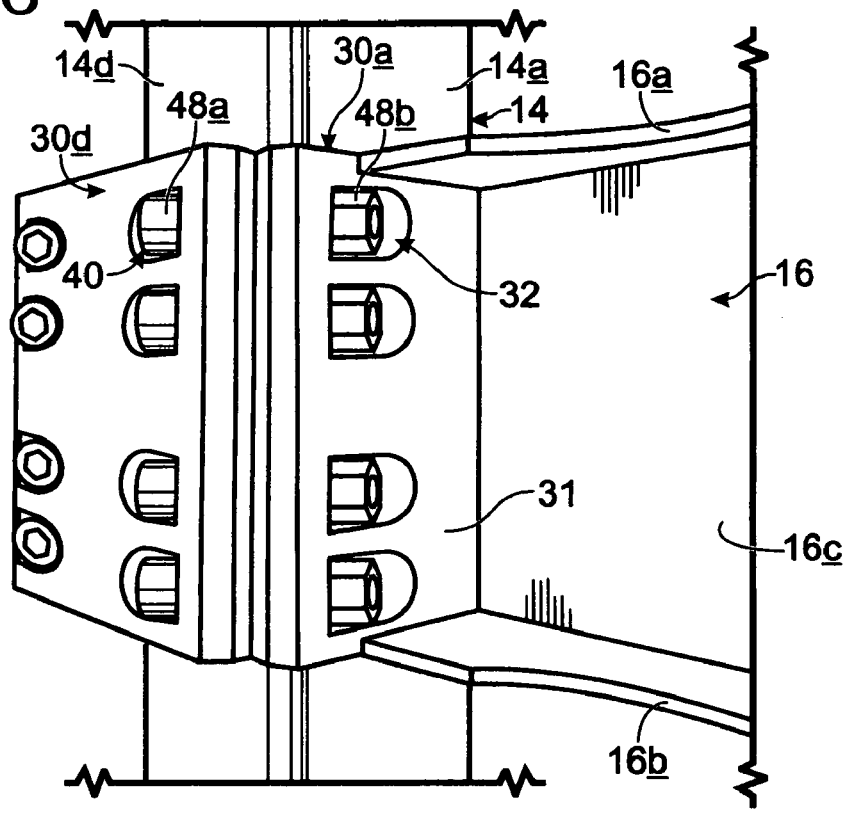
FIGS. 6 and 7 are isometric photographic views showing the collar plate involved in this invention in a representative operational setting interconnecting I-beams and a column. The version of collar plate illustrated here is modestly modified in relation to the plate structure shown in FIGS. 2–5, inclusive. Also, in these two figures, one of the collar plates shown in earlier figures with a beam end welded to it is pictured without such a beam end. This is done to expose for viewing certain structure which would otherwise be hidden.
Figure 7:
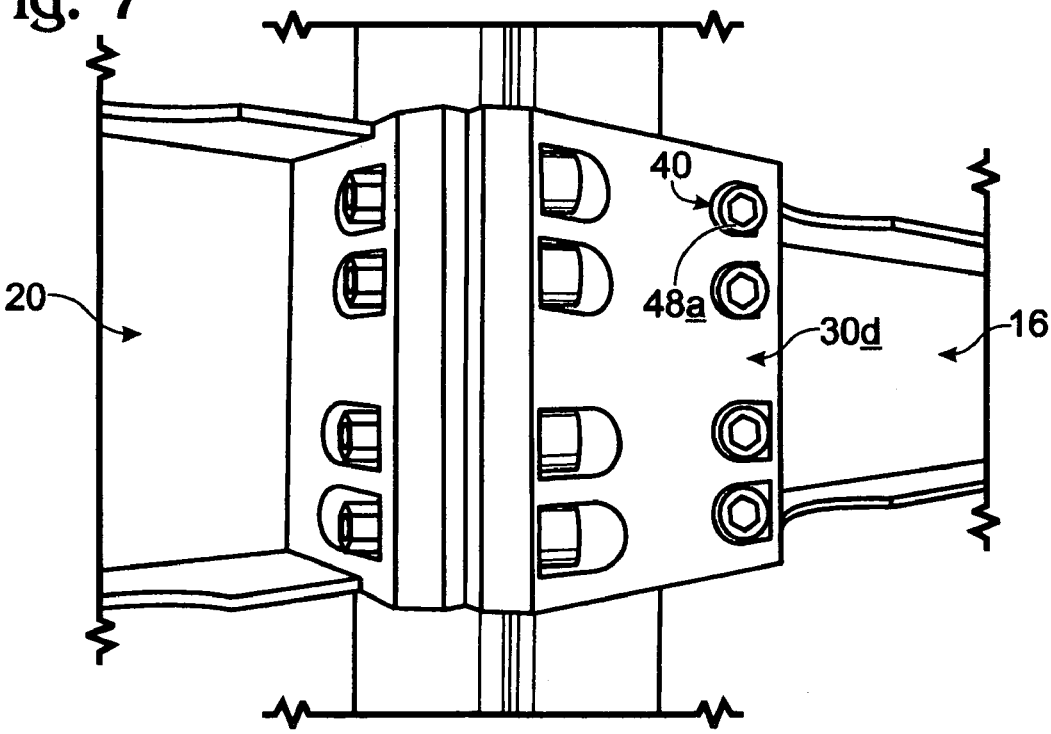

Using I-beam 16 as an illustration which can be considered to be representative of the other pictured I-beams, flanges 16*a*, 16*b* lie in vertically spaced horizontal planes (not specifically shown) which are parallel to the plane of FIG. 1, and the vertical spacing between the underside of upper flange 16*a* and the upper side of lower flange 16*b* is shown generally at $D_1$ in FIG. 1B.

Nodal connection 10 herein employs inner and outer collar structures 28, 30, respectively, which structures are interposed column 14 and beams 16, 18, 20, 22. Inner collar structure 28 includes four orthogonally related plates 28*a*, 28*b*, 28*c*, 28*d* which are welded to column faces 14*a*, 14*b*, 14*c*, 14*d*, respectively, at a common, pre-selected elevation on column 14. Outer collar structure 30 includes four plates, 30*a*, 30*b*, 30*c*, 30*d* which have been "assembled" as shown to face and connect with inner collar plates 28*a*, 28*b*, 28*c*, 28*d*, respectively. Each of plates 30*a*–30*d*, inclusive, has inner and outer, spaced, planar faces, such as inner and outer faces 29, 31, respectively, shown for plate 30*a*. Face 29, which faces column face 14*a*, is referred to as the "other" face in plate 30*a*, and face 31, which faces the illustrated end of I-beam 16, is referred to as the "one" face in the same plate.

Interposed each pair of confronting, facing plates in the inner and outer collar structures, but hidden from view in the drawing figures herein, are complementary, male/female, gravity-lock seating structures which are fully described and illustrated in the above-mentioned Regular U.S. patent application. The specific configurations of these seating structures are not part of the present invention.

Outer collar plates 30*a*, 30*b*, 30*c*, 30*d* are suitably joined, as by welding, to the pictured ends of I-beams 16, 18, 20, 22, respectively. The weld connection which exists between beam 16 and plate 30*a* exists on face 31 in that plate. In the structure now being described, the welds which join the lower side of flange 16*a* and the upper side of flange 16*b* to face 31 extend to dash-dot lines $L_1$ and $L_2$, respectively, which lie closely adjacent and between previously mentioned dimension $D_1$ (see particularly FIG. 1B).

According to the present invention, and continuing this discussion now just with reference to two of the orthogonally adjacent outer-collar plates, such as plates 30*a*, 30*d*, and even more focussedly with regard to the adjacent, lateral, vertical margins of these plates, each such margin is provided with groups of angularly disposed, vertically spaced groups of through-bores which open to enlarged, stepped cross-section, outer coaxial sockets, or chambers. In the relevant lateral margin of plate 30*a*, such four through-bores and associated sockets, also called through-passages herein, are shown at 32, 34, 36, 38, with through-bore-and-socket 32 being the uppermost one, and through-bore-and-socket 38 being the lowermost one. Similarly, in the relevant lateral margin of plate 30*d*, four such through-bores and associated sockets are shown at 40, 42, 44, 46, with through-bore-and-socket 40 being the uppermost one, and through-bore-and-socket 46 being the lowermost one. As can be clearly seen in FIGS. 1B, and 2–7 inclusive, through-passages 32, 38, 40, 46 are positioned to lie very closely adjacent the upper and lower flanges of the particular respective I-beams to which their associated inner collar plates are welded, and they lie just within the vertical boundaries of the dimension $D_1$ mentioned above, and just immediately within weld-associated lines $L_1$ and $L_2$. This is an important arrangement in accordance with the present invention.

Describing certain additional features of these through-passages, and doing this in the context of through-passages 32, 40, these passages include "steps" in dimension, shown at 32*a*, 40*a* respectively, and, in regions referred to herein as chambers, include upper and lower flat, spaced, confronting and parallel-planar surfaces 32*b*, 32*c*, and 40*b*, 40*c*, respectively. Surfaces 32*b*, 32*c*, 40*b*, 40*c* substantially parallel the planes of I-beam flanges 16*a*, 16*b*. The spacings between these two confronting surfaces in each associated through-passage are just slightly larger than the diametral spacing which exists conventionally in the spaced, diametrally opposed flat drive surfaces in the nuts which form portions of the hex nut-and-bolt assemblies that are to be used with the outer collar plates—and specifically used to join these plates angularly at their lateral edges, and to clamp these outer collar plates (as a unified outer collar) around the inner collar plates which are welded to the column faces.

The just mentioned through-passages possess what are referred to herein as reception axes, such as axes 32*d*, 38*d*, 40*d*, 46*d* for through-passages 32, 38, 40, 46, respectively. These reception axes lie herein at 45° angles relative to the nominal planes of their respective associate inner collar plates.

A consequence of this structural configuration is that when two orthogonally (angularly) adjacent outer collar plates, such as plates 30*a*, 30*d*, are properly positioned in a nodal connection, such as in connection 10, various appropriate ones of the several through-passage reception axes become substantively co-aligned. Such alignment is clearly pictured for axes 32*d*, 40*d*, and for axes 38*d*, 46*d* in FIGS. 1A and 1B.

Outer collar structure 30 is clamped to inner collar structure 28 via appropriately tightened hex nut-and-bolt sets, such as the two such sets shown in FIGS. 1A, 1B, 6 and 7 at 48, 50. In FIGS. 1A, 1B, these nut-and-bolt sets are shown exploded, but they will nevertheless be referred to herein as if they were anchored in place, and not exploded. Set 48 includes a socket-drive-bolt 48*a*, the head of which is seated in the socket portion (chamber) of through-passage 40, and a hex nut 48*b* which is seated in the socket portion (chamber) of through-passage 32. The threaded shank in bolt 48*a* extends coincidentally along aligned reception axes 32*d*, 40*d*. Nut-and-bolt set 48 possesses what is referred to herein as an assembly axis 48*c*. Axis 48*c* herein is coincident with preciously mentioned axes 32*d*, 40*d*.

Nut-and-bolt set 50 is similarly structured and organized with respect to aligned through-passages in plates 30*a*, 30*b*. Set 50 includes a socket-drive bolt 50*a*, a hex nut 50*a*, and an assembly axis 50*c*.

Another important feature of the present invention, mentioned briefly above, is the fact that each socket in each through-passage is formed with spaced upper and lower, substantially parallel-planer surfaces, such as previously mentioned surfaces 32*b*, 32*c* in through-passage 32, and surfaces 40*b*, 40*c* in through-passage 40. The spacings between these associated surfaces is just large enough to allow socket reception of hex nuts, such as hex nuts 48*b*, 50*b*, but not large enough to permit axial rotation of these nuts within the respective reception sockets. This is pictured clearly in FIG. 1C for hex nut 48*b* in relation to socket surfaces 32*b*. 32*c*. An important result of this sizing relationship is that no tool, such as a wrench, is required to stabilize the rotational position of a nut in a nut-and-bolt set during tightening of the set to effect clamping of an outer collar structure onto an inner collar structure. A one-sided, effectively one-handed, operation is all that is required, and this is performed by "socket driving" the associated bolt via the drive socket provided in the bolt head.

As can be seen, the through-passages which are provided in the outer collar plates are organized along each edge of each plate in an upright row which includes four through-passages. Such a row is referred to as being upright in the context of a fully operatively interconnected column and beam(s). These rows lie substantially parallel to the nearby associated central web 16*c* of I-beam 16.

Very specifically, in the preferred and best-mode arrangement of through-passages in each row herein, these passages are organized into two groups (upper and lower) of two passages, with the two passages in each group disposed more closely spaced (axially) relative to one another (see dimension $D_2$ in the figures) than the two next-adjacent passages in the two groups (see dimension $D_3$ in the figures).

Each group of two through-passages is, of course, and in accordance with the invention, positioned as close as possible to lines $L_1$, $L_2$. This consideration places the ultimately installed nut-and-bolt sets as near as possible to the planes of the upper and lower flanges in I-beams so as to maximize moment-handling capability in the transfers of moment loads between beams and columns.

One can now see a significant range of performance contributions and advantages which are offered and attained by the present invention. By shaping the socket portions of the described throughbore-and-socket structures as discussed with vertically spaced flattened surfaces to capture a clamping nut against axial rotation, simple one-sided nut-and-bolt tightening is enabled. The presence of these flattened surfaces results advantageously in less material being removed from the inner collar plates, and enables the vertical positioning of the upper and lower throughbore-and-socket structures in the plate's lateral margins to be very close to the elevations of an attached I-beam's flanges. This, in turn, enables the finally installed nut-and-bolt sets, grouped as described herein, to participate robustly in the cooperative handling of moment loads very close to the regions (the elevations) where I-beam flanges also act to manage such loads.

Accordingly, while a preferred and best-mode embodiment of the invention has been illustrated and described, it is appreciated that variations and modifications may be made without departing from the spirit of the invention.

I claim:

1. Beam-to-column attaching structure comprising an angular-modularity, substantially planar plate having a pair of spaced, parallel-planar faces, one of which is anchorable at the end of an elongate structural I-beam to the beam's substantially planar central web and upper and lower, substantially parallel-planar flanges, where said plate has elongate, lateral edges, and is configured to be joined through said edges to the comparable lateral edges in a pair of angularly adjacent, other, like plates, thus to form therewith a portion of a collar adapted to wrap around the outside of an elongate structural column at a defined location along the length of the column, with the other face in the plate being adapted to face the outside of such a column, and along each of said plate's said lateral edges, a row of angularly oriented through-passages, with each row lying along a line which will substantially parallel the plane of the central web in a beam having an end anchored to said one face in the plate, and with the through-passages in each row being non-uniformly spaced and organized into two, upper and lower groups which will lie clustered adjacent the upper and lower flanges, respectively, in an associated I-beam, with the spacings $D_2$ exiting between next-adjacent through-passages in each group being less than the spacing $D_3$ existing between the next-adjacent through-passages in the two groups, each through-passage accommodating the reception and utilization of a hex nut-and-bolt assembly which is defined by an elongate assembly axis, and which is designed to participate in the angular joining of the plate to a next-adjacent plate, with each through-passage having a chamber which opens to said one face in the plate, and which includes a pair of spaced, parallel-planar surfaces adapted, with respect to any nut residing in the chamber, to engage the nut, thus to prevent rotation of that nut about its associated assembly axis.

2. The structure of claim 1, wherein said surfaces in said chamber, with said plate anchored to the end of an I-beam, lie in planes that substantially parallel the planes of the I-beam's flanges.

* * * * *